US006821171B1

(12) United States Patent
Wynveen et al.

(10) Patent No.: US 6,821,171 B1
(45) Date of Patent: Nov. 23, 2004

(54) COOLING SYSTEM FOR A FOUR CYCLE OUTBOARD ENGINE

(75) Inventors: Steven Wynveen, Germantown, WI (US); David J. Belter, West Bend, WI (US); Timothy S. Reid, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/632,055

(22) Filed: Jul. 31, 2003

(51) Int. Cl.[7] ..... B63H 21/10

(52) U.S. Cl. ..... 440/88 C; 440/88 D; 440/88 G; 440/89 B; 123/41.08; 123/41.82 R

(58) Field of Search ..... 440/88 R, 88 L, 440/88 C, 88 G, 88 J, 89 R, 89 B, 89 C; 123/41.02, 41.08, 41.44, 41.72, 41.74, 41.82 R

(56) References Cited

U.S. PATENT DOCUMENTS

| | | | | | |
|---|---|---|---|---|---|
| 3,105,472 | A | * | 10/1963 | Jasper | 123/41.08 |
| 3,358,654 | A | * | 12/1967 | Shanahan et al. | 123/41.08 |
| 4,312,304 | A | * | 1/1982 | Tyner | 123/41.74 |
| 4,674,449 | A | * | 6/1987 | Hundertmark | 123/41.08 |
| 5,048,467 | A | * | 9/1991 | Kojima | 123/41.74 |
| 5,261,356 | A | * | 11/1993 | Takahashi et al. | 123/41.31 |
| 5,383,803 | A | | 1/1995 | Pilgrim | 440/88 |
| 5,522,351 | A | | 6/1996 | Hudson | 123/41 |
| 5,873,330 | A | * | 2/1999 | Takahashi et al. | 123/41.31 |
| 5,937,801 | A | | 8/1999 | Davis | 123/41 |
| 5,937,802 | A | * | 8/1999 | Bethel et al. | 123/41.74 |
| 5,980,340 | A | * | 11/1999 | Okamoto | 440/88 L |
| 6,068,529 | A | | 5/2000 | Weronke et al. | 440/88 |
| 6,295,963 | B1 | | 10/2001 | Kollock et al. | 123/193 |
| 6,347,969 | B1 | * | 2/2002 | Takahashi | 440/88 R |
| 6,405,692 | B1 | | 6/2002 | Christiansen | 123/65 |
| 6,408,832 | B1 | | 6/2002 | Christiansen | 123/563 |
| 6,471,559 | B2 | * | 10/2002 | Kashima | 440/88 R |

FOREIGN PATENT DOCUMENTS

| | | | | |
|---|---|---|---|---|
| JP | 11062580 A | * | 3/1999 | F01P/3/20 |
| JP | 2001098942 A | * | 4/2001 | F01P/3/20 |
| JP | 2002242673 A | * | 8/2002 | F01P/3/02 |

* cited by examiner

*Primary Examiner*—S. Joseph Morano
*Assistant Examiner*—Ajay Vasudeva
(74) *Attorney, Agent, or Firm*—William D. Lanyi

(57) ABSTRACT

A cooling system for a marine engine conducts water from a coolant pump through the cylinder head and exhaust conduit prior to conducting the cooling water through the cylinder block. This raises the temperature of the water prior to its entering the cooling passages of the cylinder block.

13 Claims, 2 Drawing Sheets

COOLING SYSTEM FOR A FOUR CYCLE OUTBOARD ENGINE

BACKGROUND OF THE INVENTION

1. Field of the Invention

The present invention is generally related to a cooling system for a four cycle engine and, more particularly, to a cooling system that connects the cooling cavities of the cylinder head, exhaust conduit, and cylinder block of the engine in series fluid communication with each other in a manner which conducts the cooling water through the cylinder block only after the cooling water has passed through the cylinder head and the exhaust conduit.

2. Description of the Prior Art

Many types of cooling systems are well known to those skilled in the art for removing heat from an internal combustion engine used in conjunction with a marine propulsion system.

U.S. Pat. No. 5,937,802, which issued to Bethel et al on Aug. 17, 1999, discloses an engine cooling system for an internal combustion engine which is provided with coolant paths through the cylinder block and cylinder head which are connected in serial fluid communication with each other. In parallel with the cooling path through the cylinder head, a first drain is connected in serial fluid communication with a pressure responsive valve and the path through the cylinder block. A temperature responsive valve is connected in serial fluid communication with the cylinder head path and in parallel fluid communication with the first drain. A pump is provided to induce fluid flow through the first and second coolant conduits and the first and second drains, depending on the state of the pressure responsive valve and the temperature responsive valve.

U.S. Pat. No. 6,068,529, which issued to Weronke et al on May 30, 2000, discloses a water propulsion unit with dual water inlet structure. A vertical drive shaft is journaled in the lower gearcase and drives a pair of bevel gears. The propulsion unit includes a dual cooling water pick-up system in which seawater is drawn to the water pump both through a series of vertical inlet ports in the gearcase and through a plurality of inlet holes that are located in the forward end of the lower torpedo section.

U.S. Pat. No. 5,937,801, which issued to Davis on Aug. 17, 1999, discloses an oil temperature moderator for an internal combustion engine. A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated valve which restricts the flow from the outlet of the internal combustion engine to the space near the oil pan. One embodiment of the cooling system also provides a darn within the space adjacent to the outer surface of the oil pan to divide that space into first and second portions. The dam further slows the flow of water as it passes in thermal communication with the oil pan.

U.S. Pat. No. 5,383,803, which issued to Pilgrim on Jan. 24, 1995, describes an outboard motor cooling system. An outboard motor is equipped with a closed circuit cooling system having a coolant pump, a heat exchanger, an expansion tank, a series of coolant passage in the motor and some external piping to complete the circuit. In one embodiment of the invention, a conventional outboard motor is modified to include the closed circuit coolant system with the conventional water pump being converted to the coolant pump. In this modified embodiment, the thermostat seals have to be modified, the pump has to be sealed, and several bypass holes have to be plugged in the engine to isolate the flow of the coolant.

U.S. Pat. No. 6,295,963, which issued to Kollock et al on Oct. 2, 2001, discloses a four cycle engine for marine propulsion system. A marine engine is made with a head portion that includes an exhaust manifold that is formed as an integral part of the head portion during a lost foam casting procedure. The head portion comprises a plurality of combustion chambers in which each combustion chamber has at least one exhaust throat that connects the combustion chamber in fluid communication with at least one exhaust port. All of the exhaust ports connect associated combustion chambers in fluid communication with an exhaust manifold that is formed integrally within the head portion during the initial lost foam casting process. An exhaust outlet opening from the exhaust manifold is positioned above at least one exhaust port of at least one combustion chamber to form a water trap or stand pipe that inhibits water ingestion under certain adverse conditions. Water passages and oil passages are formed integrally within the head portion during the lost foam casting process. The head portion of the present invention reduces the number of components needed to provide the functions of the cylinder head portion and, as a result, improves reliability and reduces cost.

U.S. Pat. No. 6,405,692, which issued to Christiansen on Jun. 18, 2002, discloses an outboard motor with a screw compressor supercharger. The outboard motor has a screw compressor which provides a pressurized charge for the combustion chambers of the engine. The screw compressor has first and second screw rotors arranged to rotate about vertical axes which are parallel to the axes of a crankshaft of the engine. A bypass valve regulates the flow of air through a bypass conduit extending from an outlet passage of the screw compressor to the inlet passage of the screw compressor. A charge air cooler is used in a preferred embodiment and the bypass conduit then extends between the cold side plenum of the charge air cooler and the inlet of the compressor. The bypass valve is controlled by an engine control module in order to improve power output from the engine at low engine speeds while avoiding any violation of existing limits on the power of the engine at higher engine speeds.

U.S. Pat. No. 6,408,832, which issued to Christiansen on Jun. 25, 2002, discloses an outboard motor with a charge air cooler. An outboard motor is provided with an engine having a screw compressor which provides a pressurized charge for the combustion chambers of the engine. A charge air cooler is used in a preferred embodiment and the bypass conduit of the screw compressor then extends between the cold side plenum of the charge air cooler and the inlet of the compressor. The charge air cooler improves the operating efficiency of the engine and avoids overheating the air as it passes through the supercharger after flowing through a bypass conduit. The bypass valve is controlled by an engine control module in order to improve power output from the engine at low engine speeds while avoiding any violation of existing limits on the power of the engine at higher engine speeds.

U.S. Pat. No. 5,522,351, which issued to Hudson on Jun. 4, 1996, discloses an internal combustion engine temperature control system. The invention is a liquid to liquid heat exchanger incorporated into the body of an internal combustion engine. The first cooling liquid (e.g. oil) is circulated through passages in the engine block and along one side of a heat conducting wall integral with the engine block. A second cooling liquid (e.g. water) is circulated through a cooling water passage adjacent to the heat conducting wall to remove heat from the first cooling liquid. It may also be pumped through other passages within the engine block for cooling purposes.

U.S. Pat. No. 4,674,449, which issued to Hundertmark on Jun. 23, 1987, discloses a pressure regulated cooling system. The cooling system for the engine of an outboard motor uses a pressure relief valve to control the coolant pressure and flow through the cylinder block. The relief valve member controls flow at the outlet of the block and is controlled by a diaphragm responding to pump discharge pressure at the inlet of the block. An orifice bypasses flow around the block when the main valve seat is closed and is closed by the valve member when the main valve seat is fully opened.

Some four cycle outboards exhibit a problem with regard to fuel dilution of oil when the engine is used in cold water. When lubricating oil is diluted with fuel, it does not offer the degree of lubrication that undiluted oil does. This can lead to accelerated wear of various moving parts of the engine. When an engine block is operating at relatively cold temperatures, the problem of fuel dilution is increased significantly. It would therefore be beneficial if a cooling system for a marine engine could be developed in which the cylinder block is prevented from operating for significant periods of time at temperatures that are below a desirable threshold.

The patents described above are hereby expressly incorporated by reference in the description of the present invention.

SUMMARY OF THE INVENTION

A cooling system for a marine propulsion device, made in accordance with the preferred embodiment of the present invention, comprises a water pump for drawing water from a body of water in which the marine propulsion device is operated, an engine having a cylinder head, a cylinder block, and an exhaust conduit connected in fluid communication with the engine to conduct exhaust gases away from the engine. It further comprises a first cooling passage disposed in thermal communication with the cylinder head, a second cooling passage disposed in thermal communication with the exhaust conduit, and a third cooling passage disposed in thermal communication with the cylinder block.

The first, second, and third cooling passages are connected in series fluid communication with each other. An outlet of the water pump is connected in fluid communication with the first, second, and third cooling passages in order to induce the cooling water to flow in a serial path through the first, second, and third cooling passages.

In a preferred embodiment of the present invention, the first and second cooling passages are connected between the water pump and the third cooling passage. The first cooling passage is connected between the water pump and the second cooling passage.

An inlet of the first cooling passage is disposed below an outlet of the first cooling passage. An inlet of the second cooling passage is disposed above the outlet of the second cooling passage. An inlet of the third cooling passage is is disposed below an outlet of the third cooling passage. The outlet of the third cooling passage is configured to return the cooling water to the body of water from which it was drawn by the water pump.

A charge air cooler is provided in certain embodiments of the present invention. The charge air cooler has a fourth cooling passage which has an inlet connected to the outlet of the water pump. An oil cooler has a fifth cooling passage with an inlet of the fifth cooling passage being connected to an outlet of the fourth cooling passage. As a result, water flows in a serial path through the fourth and fifth cooling passages. The first, second, and third cooling passages are disposed in parallel fluid communication with the fourth and fifth cooling passages.

Although the present invention, in a particularly preferred embodiment, connects the first and second cooling passages in series with each other, it should be understood that in other embodiments, only one of the first and second cooling passages may be connected to the third cooling passage. In alternative embodiments of the present invention, the first and second cooling passages can be connected in series with a third cooling passage, the first cooling passage can be connected in serial fluid communication with the third cooling passage, or the second cooling passage can be connected in serial fluid communication with the third cooling passage. In other words, the primary benefit of the present invention is that the cooling water is preheated by passing through either the first or second cooling passages, or both, prior to flowing through the third cooling passage. This heats the cooling water prior to it passing in thermal communication with the cylinder block.

BRIEF DESCRIPTION OF THE DRAWINGS

The present invention will be more fully and completely understood from a is reading of the description of the preferred embodiment in conjunction with the drawings, in which.

DESCRIPTION OF THE PREFERRED EMBODIMENT

Figure 1:
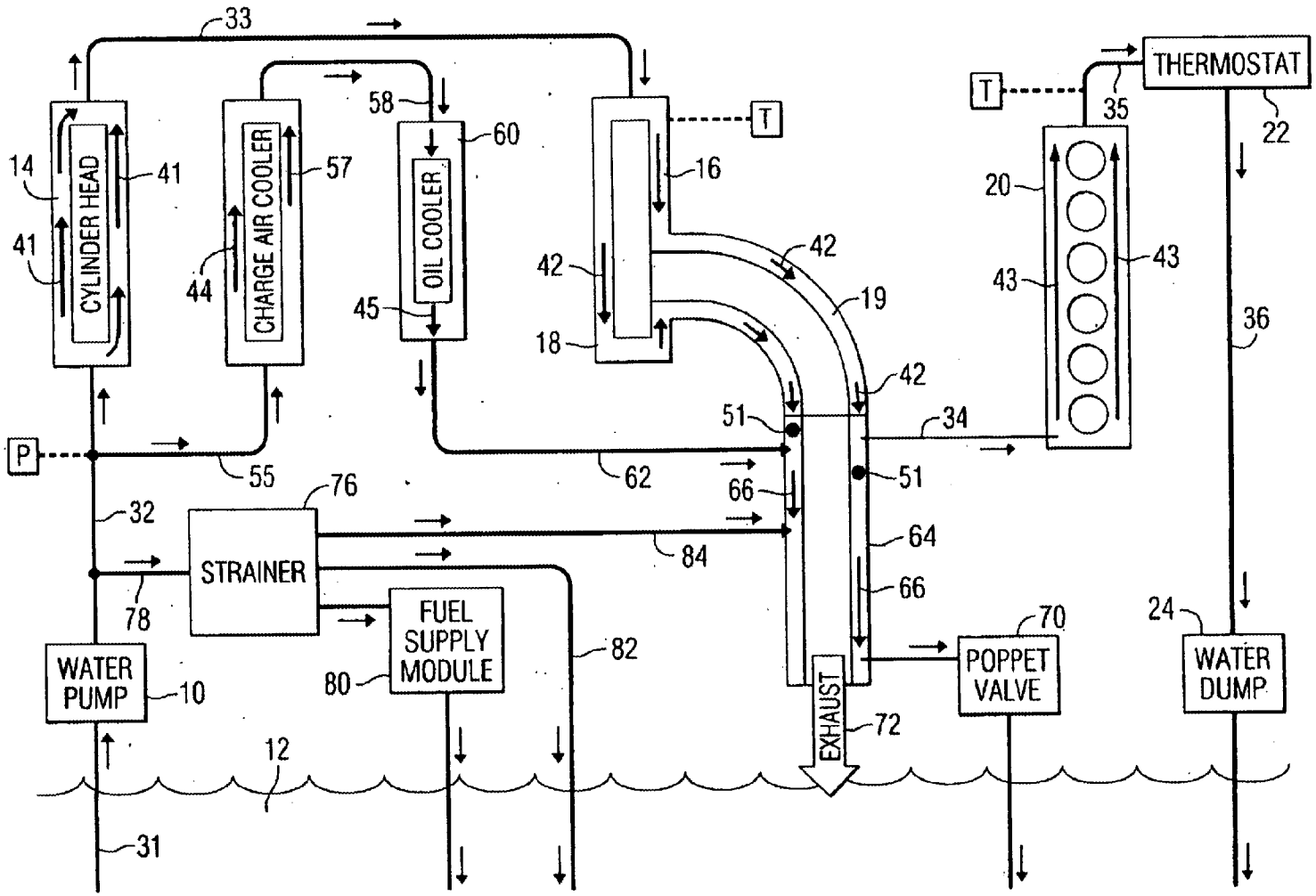
FIG. 1 is a schematic representation of a coolant circuit of a marine engine made in accordance with the preferred embodiment of the present invention.

Throughout the description of the preferred embodiment of the present invention, like components will be identified by like reference numerals.

FIG. 1 is a schematic representation of an internal combustion engine with a cooling circuit for removing heat from heat producing portions of the system. A water pump 10 draws water from a body of water 12, as represented by arrow 31. Water is pumped, as represented by arrow 32, through the cooling passage 41 of the cylinder head 14. After passing through the cylinder head 14, in a direction from bottom to top, the cooling water flows to an exhaust conduit 16, as represented by arrow 33. Water fills the cooling passage 42 of the exhaust conduit 16. The exhaust conduit 16 comprises an exhaust manifold portion 18 and an exhaust pipe portion 19. The cooling water then flows to a bottom inlet portion of the cylinder block 20, as represented by arrow 34. The cooling water flows upwardly through the cooling passage 43 within the cylinder block 20 and to a thermostat 22 as represented by arrow 35. When the water exceeds the preselected temperature range of the thermostat 22, it flows to a water dump portion within the driveshaft housing of an outboard motor. This flow is represented by arrow 36 and the water dump portion is identified by reference numeral 24.

As can be seen in FIG. 1, a serial fluid communication exists for the water path from the water pump 10 to the outlet of the cylinder block 20. This serial path comprises arrows 32–36 and the cooling passages, 41–43, within the cylinder head 14, the exhaust conduit 16, and the cylinder block 20, respectively.

It should be understood that the cylinder head 14 and cylinder block 20 comprise internal cooling passages, or cavities, 41 and 43, respectively, which act as conduits through which cooling water flows. The concept of providing internal cavities, or cooling passages, in cylinder heads and cylinder blocks is well known to those skilled in the art and will not be described in detail herein. In addition, it is well known to provide a cooling passage 42 in the exhaust conduit 16 to remove heat caused by the passage of hot exhaust gases through the exhaust conduit 16. The first cooling passage, represented by arrows 41, is disposed in thermal communication with the cylinder head 14 and conducts cooling water from an inlet of the cylinder head 14 to its outlet. The second cooling passage, represented by arrows 42, is disposed in thermal communication with the exhaust conduit 16. The third cooling passage, represented by arrows 43, is disposed in thermal communication with the cylinder block 20. Arrows 33 and 34 illustrate the fluid path between the cylinder head 14, the exhaust conduit 16, and the cylinder block 20. As can be seen, this fluid path is serial in nature. A fluid dam, which comprises elastomeric fluid blocking members 51, causes the water which is flowing through the second cooling passage 42 to be directed to an inlet of the cylinder block 20.

Some of the water pumped by the water pump 10 from the body of water 12 is directed, as represented by arrow 55, through a charge air cooler 57. If the engine is supercharged, the charge air cooler can be used to reduce the temperature of the air flowing from the compressor to the engine. The water is then directed, as represented by arrow 58, through an oil cooler 60. The cooling water is then directed from the oil cooler 60, as identified by arrow 62, to a location that conducts the water through a portion of the exhaust pipe 64, as represented by arrows 66. A poppet valve 70 releases the water to flow back to the body of water 12 when the pressure within the exhaust pipe 64 exceeds a preselected range. Arrow 72 represents the flow of exhaust gases from the engine. The fluid path that comprises arrows 55, 58, 62, and 66 flows serially through the charge air cooler 57 and oil cooler 60. This path is disposed in parallel fluid communication with the serial path through the first cooling passage 41, the second cooling passage 42, and the third cooling passage 43.

With continued reference to FIG. 1, some of the flow from the water pump 10 is directed through a strainer 76, as represented by arrow 78. This water, after passing through the strainer 76, is distributed to a fuel supply module 80, a tell tale stream 82 and the exhaust pipe 64, as represented by arrow 84.

With continued reference to FIG. 1, it can be seen that the engine cooling water cools the cylinder head 14 from the bottom up, then flows to the exhaust conduit 16 and cools it from the top down, and then flows to the cylinder block 20 and cools it from the bottom up. The outlet from the cylinder block 20 is controlled by a thermostat 22. The arrangement shown in FIG. 1 takes advantage of the major heat sources, which include the cylinder head 14 and the exhaust conduit 16, to warm the water significantly before it flows into the cylinder block to cool the cylinder bores. All of the water flowing into the lower portion of the cylinder block 20 flows through the cylinder head 14 and the exhaust conduit 16 before it enters the cylinder block 20. This allows the water to be warmed above a threshold value so that condensation of fuel is limited on the cylinder bores of the cylinder block 20. The arrangement shown in FIG. 1 minimizes the temperature gradient across the cylinder block 20 in a vertical direction with more uniform warming of the cylinder bores. As a result, the cooling system exhibits resistance to fuel dilution that could result from the condensation of fuel vapors within a cold cylinder block 20.

As can be seen in FIG. 1, the present invention provides a water pump 10 for drawing water from a body of water 12, in which the marine propulsion system is operated. An engine is provided with a cylinder head 14 and a cylinder block 20. An exhaust conduit 16 is connected in fluid communication with the engine to conduct exhaust gases 72 away from the engine. A first cooling passage 41 is disposed in thermal communication with the cylinder head 14. A second cooling passage 42 is disposed in thermal communication with the exhaust conduit 16. A third cooling passage 43 is disposed in thermal communication with the cylinder block 20. A preselected cooling passage, selected from the group consisting of the first and second cooling passages, 41 and 42, is connected in series with the third cooling passage 43. As a result, an outlet of the water pump 10 is connected in fluid communication with the preselected cooling passage to induce a flow of cooling water to flow in a serial path through the preselected cooling passage (e.g. 41 or 42) and subsequently through the third cooling passage 43. The important characteristic of the present invention is that the cooling water first flows through the cylinder head 14 and the exhaust conduit 16, prior to its flowing through the third cooling passage 43 of the cylinder block 20.

The first and second cooling passages, 41 and 42, are shown in FIG. 1 as being connected between the water pump 10 and the third cooling passage 43. The first cooling passage 41 is shown being connected between the water pump 10 and the second cooling passage 42. An inlet of the first cooling passage 41 is disposed below an outlet of the first cooling passage 41, an inlet of the second cooling passage 42 is disposed above an outlet of the second cooling passage 42. An inlet of the third cooling passage 43 is disposed below an outlet of the third cooling passage 43, the outlet of the third cooling passage 43 is configured to return the cooling water to the body of water 12. The preselected cooling passage, described above, is the first cooling passage 14 in a preferred embodiment of the present invention. However, it should be understood that the preselected cooling passage could alternatively be the second cooling passage 42. A charge air cooler 57 has a fourth cooling passage 44 and an oil cooler 60 has a fifth cooling passage 45. An inlet of the fifth cooling passage 45 is connected to an outlet of the fourth cooling passage 44 so that water flows in a serial path through the fourth and fifth cooling passages, 44 and 45. This serial path through the charge air cooler 57 and the oil cooler 60 is connected in parallel to the serial fluid path through the cylinder head 14, the exhaust conduit 16, and the cylinder block 20.

Several important characteristics of the present invention can be seen in FIG. 1. First, the coolant fluid path through the cylinder head 14, the exhaust conduit 16, and the cylinder block 20 is a series fluid path. In addition, cooling water flows at least through the cylinder head 14 and the exhaust conduit 16 prior to flowing through the cylinder block 20. This heats the water before it flows into the third cooling passage 43 of the cylinder block 20. In addition, it should be noted that the cooling system shown in FIG. 1 is an open cooling system in which water is drawn from a body of water 12 and returned to that body of water 12 after it is used to cool heat generating components of the engine.

The temperature of the body of water 12, in which the marine propulsion system is operated can vary significantly. Tests have been performed with the system shown in FIG. 1 operated in both relatively warm water and relatively cold water. When operated in warm water, the temperature of the water flowing through the water pump 10 and into the cylinder head 14 is approximately 38 degrees centigrade. As the water flows out of the cylinder head, as represented by arrow 33, its temperature is approximately 47 degrees centigrade. As it flows into the cylinder block 20, as represented by arrow 34, its temperature is approximately 63 degrees centigrade. Flowing out of the cylinder block 20, as represented by arrow 35, the water temperature is approximately 67 degrees centigrade. It can be seen that as the water flows serially through the cylinder head 14 and exhaust conduit 16, it warms appreciably. In the example described above, the temperature gained 25 degree centigrade as it flows from the water pump 10 to the inlet of the cylinder block 20.

When operated in cold water, a similar beneficial effect is noticed. If the water flowing through the water pump 10 is approximately 13 degrees centigrade, it increases to approximately 29 degrees centigrade as it exits from the cylinder head 14 as represented by arrow 33. By the time that the water enters the inlet of the cylinder block 20, it is approximately 55 degrees centigrade as represented by arrow 34. As it flows out of the cylinder block 20, the water temperature is approximately 63 degrees centigrade.

These two examples, including operation in both warm water and cold water, show that the temperature of the water flowing through the cylinder block 20 is increased significantly as it flows from the water pump 10 to the cylinder block 20. When the marine engine is operated in cold water, it increases in temperature by approximately 42 degrees centigrade and when it is operated in warm water, it increases by approximately 25 degrees centigrade. The cold water operation results in water flowing into the cylinder block 20 at approximately 55 degrees centigrade and the warm water operation results in water flowing into the cylinder block 20 at approximately 63 degrees centigrade.

Figure 2:
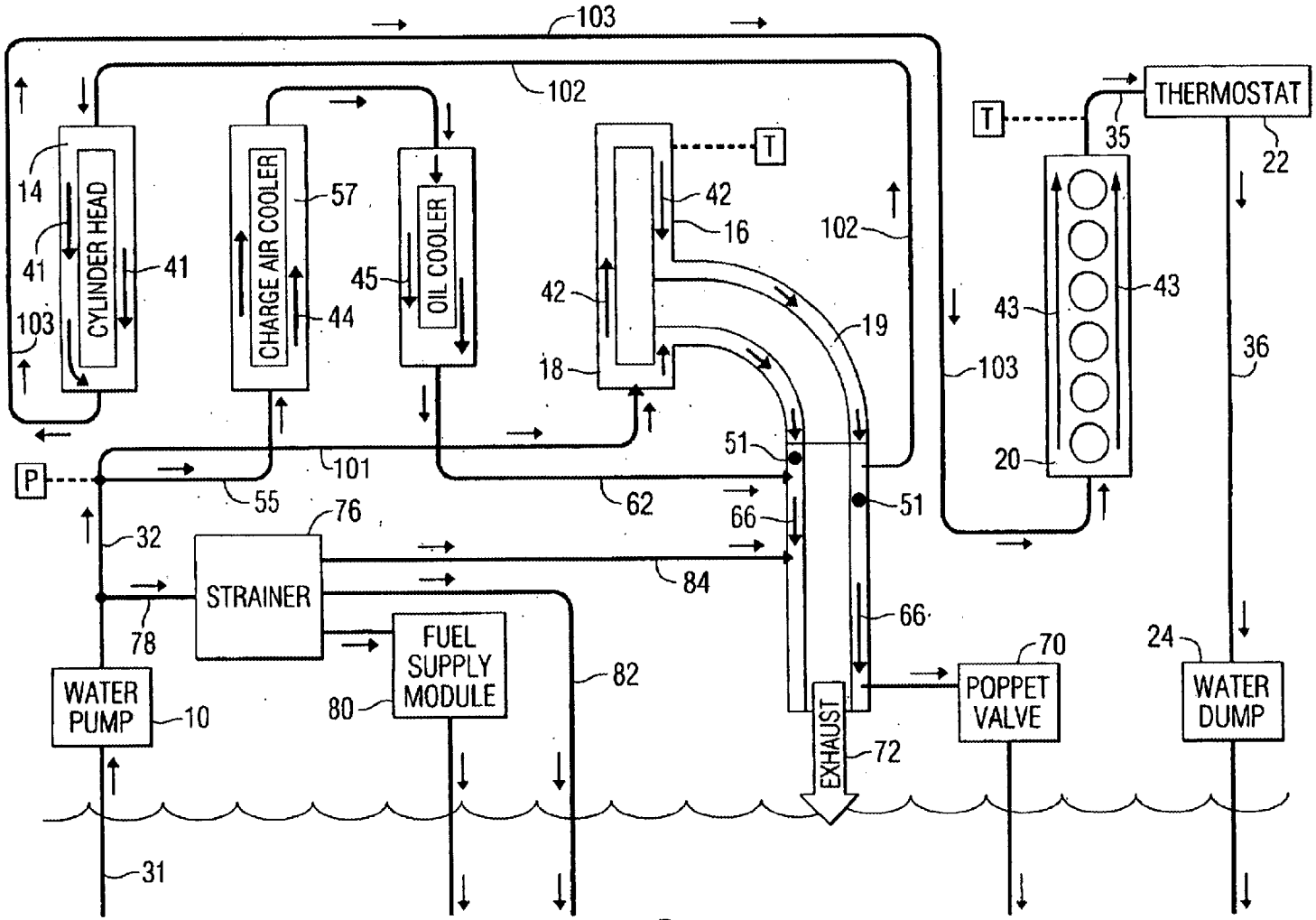
FIG. 2 is an alternative embodiment of the present invention.

FIG. 2 is shows a cooling system that is generally similar to that described above in conjunction with FIG. 1, but with a variation in the order in which the water flows through the first and second cooling passages, 41 and 42. The water flowing from the water pump 10, as represented by arrow 32, is directed to the exhaust conduit 16, as represented by arrow 101. After flowing through the second cooling passage 42, the water is directed, as shown by arrows 102, to the cylinder head 14 and the first cooling passage 41. After flowing through the cylinder head 14, the water is directed, as represented by arrows 103, to the inlet of the cylinder block 43. In other words, the cooling circuit shown in FIG. 2 is similar to that of FIG. 1 except for the fact that the water flows through the exhaust conduit 16 prior to flowing through the cylinder head 14. The water flows through the second cooling passage 42 before the first cooling passage 41. In both embodiments, however, the water flows through both the cylinder head 14 and exhaust conduit 16 prior to flowing through the cylinder block 20. The order in which the water flows through the cylinder head 14 and the exhaust conduit 16 is not as critical to the present invention as the fact that it flows through these two portions of the engine prior to flowing through the third cooling passage 43 of the cylinder block 20.

Although the present invention has been described with particular specificity and illustrated to show a preferred embodiment and an alternate embodiment, it should be understood that other embodiments are also within its scope.

We claim:

1. A cooling system for a marine propulsion device, comprising:

a water pump for drawing water from a body of water in which said marine propulsion device is operated;

an engine having a cylinder head and a cylinder block;

an exhaust conduit connected in fluid communication with said engine to conduct exhaust gasses away from said engine;

a first cooling passage disposed in thermal communication with said cylinder head;

a second cooling passage disposed in thermal communication with said exhaust conduit;

a third cooling passage disposed in thermal communication with said cylinder block, said first and second cooling passages being connected in series with each other and with said third cooling passage, wherein an outlet of said water pump is connected in fluid communication with said water pump to cause at least half of the water flowing through said third cooling passage to first flow through said first and second cooling passages, said first cooling passage being connected serially between said water pump and said second cooling passage; and a charge air cooler having a fourth cooling passage, said fourth cooling passage having an inlet connected to said outlet of said water pump.

2. The cooling system of claim 1, wherein:

said first and second cooling passages being connected between said water pump and said third cooling passage.

3. The cooling system of claim 1, wherein:

an inlet of said first cooling passage is disposed below an outlet of said first cooling passage, an inlet of said second cooling passage being disposed above an outlet of said second cooling passage, an inlet of said third cooling passage being disposed below an outlet of said third cooling passage, said outlet of said third cooling passage being configured to return said cooling water to said body of water.

4. The cooling system of claim 1, further comprising:

an oil cooler having a fifth cooling passage, an inlet of said fifth cooling passage being connected to an outlet of said fourth cooling passage, whereby water flows in a serial path through said fourth and fifth cooling passages.

5. A cooling system for a marine propulsion device, comprising:

a coolant pump for inducing a flow of coolant through said cooling system;

an internal combustion engine having a cylinder head and a cylinder block;

an exhaust conduit connected in fluid communication with said engine to conduct exhaust gasses away from said engine;

a first coolant conduit disposed in thermal communication with said cylinder head;

a second coolant conduit disposed in thermal communication with said exhaust conduit;

a third coolant conduit disposed in thermal communication with said cylinder block, said first, second, and third coolant conduits being connected in series fluid communication with each other, wherein an outlet of said coolant pump is connected in fluid communication with said first, second, and third coolant conduits, said first coolant conduit being disposed serially between said coolant pump and said second coolant conduit, an inlet of said first coolant conduit being disposed below an outlet of said first coolant conduit, an inlet of said second coolant conduit being disposed above an outlet of said second coolant conduit, an inlet of said third coolant conduit being disposed below an outlet of said third coolant conduit, said outlet of said third coolant conduit being configured to return said coolant water to said body of water; and whereby at least half of the coolant flowing through the third coolant conduit has first passed through said first and second coolant conduits.

6. The cooling system of claim 5, wherein:

said first and second coolant conduits are connected between said coolant pump and said third coolant conduit.

7. The cooling system of claim 6, wherein:

said outlet of said third coolant conduit is configured to return said water to said body of water.

8. The cooling system of claim 7, further comprising:

a charge air cooler having a fourth coolant conduit, said fourth coolant conduit having an inlet connected to said outlet of said water pump.

9. The cooling system of claim 8, further comprising:

an oil cooler having a fifth coolant conduit, an inlet of said fifth coolant conduit being connected to an outlet of said fourth coolant conduit, whereby water flows in a serial path through said fourth and fifth coolant conduits.

10. A cooling system for a marine propulsion device, comprising:

an engine having a cylinder head and a cylinder block;

an exhaust conduit connected in fluid communication with said engine to conduct exhaust gasses away from said engine;

a cylinder head cooling passage disposed in thermal communication with said cylinder head;

a exhaust conduit cooling passage disposed in thermal communication with said exhaust conduit;

a cylinder block cooling passage disposed in thermal communication with said cylinder block, wherein, said cylinder head cooling passage, exhaust conduit cooling passage, and cylinder block cooling passage are connected in series with each other to receive a flow of cooling water and configured to conduct at least half of the flow of said cooling water through said cylinder block cooling passage after said cooling water flows through said cylinder head cooling passage and exhaust conduit cooling passage; and a water pump for drawing said cooling water from a body of water in which said marine propulsion device is operated, an outlet of said water pump being connected to an inlet of said cylinder head cooling passage, an inlet of said cylinder head cooling passage being disposed below an outlet of said cylinder head cooling passage, an inlet of said exhaust conduit cooling passage being disposed above an outlet of said exhaust conduit cooling passage, an inlet of said cylinder block cooling passage being disposed below an outlet of said cylinder block cooling passage, said outlet of said cylinder block cooling passage being configured to return said cooling water to said body of water.

11. The cooling system of claim 10, further comprising:

a charge air cooler having a fourth cooling passage, said fourth cooling passage having an inlet connected to said outlet of said water pump.

12. The cooling system of claim 11, further comprising:

an oil cooler having a fifth cooling passage, an inlet of said fifth cooling passage being connected to an outlet of said fourth cooling passage, whereby water flows in a serial path through said fourth and fifth cooling passages, said cylinder head cooling passage, exhaust conduit cooling passage, and cylinder block cooling passage being disposed in parallel with said fourth and fifth cooling passages.

13. A cooling system for a marine propulsion device, comprising:

a water pump for drawing water from a body of water in which said marine propulsion device is operated;

an engine having a cylinder head and a cylinder block;

an exhaust conduit connected in fluid communication with said engine to conduct exhaust gasses away from said engine;

a first cooling passage disposed in thermal communication with said cylinder head;

a second cooling passage disposed in thermal communication with said exhaust conduit; and a third cooling passage disposed in thermal communication with said cylinder block, said first and second cooling passages being connected in series with each other and with said third cooling passage, wherein an outlet of said water pump is connected in fluid communication with said water pump to cause at least half of the water flowing through said third cooling passage to first flow through said first and second cooling passages, said first cooling passage being connected serially between said water pump and said second cooling passage, an inlet of said first cooling passage being disposed below an outlet of said first cooling passage, an inlet of said second cooling passage being disposed above an outlet of said second cooling passage, an inlet of said third cooling passage being disposed below an outlet of said third cooling passage, said outlet of said third cooling passage being configured to return said cooling water to said body of water.

* * * * *